US007024904B2

(12) United States Patent
Dupas

(10) Patent No.: US 7,024,904 B2
(45) Date of Patent: Apr. 11, 2006

(54) CONTOUR ROLL FORMER IN PARTICULAR FOR EXTRUDED METAL PROFILES

(75) Inventor: Philippe Maurice Jean Camille Dupas, Suce-sur-Erdre (FR)

(73) Assignee: Usinor, Puteaux (FR)

( * ) Notice: Subject to any disclaimer, the term of this patent is extended or adjusted under 35 U.S.C. 154(b) by 45 days.

(21) Appl. No.: 10/467,162

(22) PCT Filed: Oct. 24, 2002

(86) PCT No.: PCT/FR02/03660

§ 371 (c)(1),
(2), (4) Date: Dec. 31, 2003

(87) PCT Pub. No.: WO03/035296

PCT Pub. Date: May 1, 2003

(65) Prior Publication Data

US 2004/0168499 A1 Sep. 2, 2004

(30) Foreign Application Priority Data

Oct. 25, 2001 (FR) ..... 01 13812

(51) Int. Cl.
*B21D 5/08* (2006.01)

(52) U.S. Cl. ..... 72/181; 72/226; 72/176

(58) Field of Classification Search ..... 72/179, 72/181, 176, 226, 238, 239, 256
See application file for complete search history.

(56) References Cited

U.S. PATENT DOCUMENTS

| | | | | |
|---|---|---|---|---|
| 19,799 | A * | 3/1858 | Stephens | 228/144 |
| 3,453,852 | A * | 7/1969 | Valente | 72/164 |
| 3,750,446 | A * | 8/1973 | Jones, Jr. | 72/181 |
| 3,777,531 | A * | 12/1973 | McClain | 72/181 |
| 4,903,516 | A | 2/1990 | Olsson et al. | 72/181 |
| 4,974,435 | A * | 12/1990 | Vandenbroucke | 72/176 |
| 5,823,036 | A * | 10/1998 | Matsunaga | 72/181 |
| 6,282,932 | B1 | 9/2001 | Surina et al. | 72/7.6 |
| 6,289,708 | B1 * | 9/2001 | Keinanen | 72/178 |

FOREIGN PATENT DOCUMENTS

| | | |
|---|---|---|
| DE | 31 28 126 | 2/1983 |
| EP | 0 993 883 | 4/2000 |

* cited by examiner

*Primary Examiner*—Daniel C. Crane
(74) *Attorney, Agent, or Firm*—Jacobson Holman PLLC

(57) ABSTRACT

A contour roll former capable of operating with different sets of pairs of roll forming heads depending on the type of extruded profile to be produced. The contour roll former includes pairs of heads mounted on carriages capable of sliding horizontally back and forth along a direction transverse to the forming line, so that it is possible to replace one set with another with minimum handling, requiring only horizontal movement of the carriages.

20 Claims, 2 Drawing Sheets

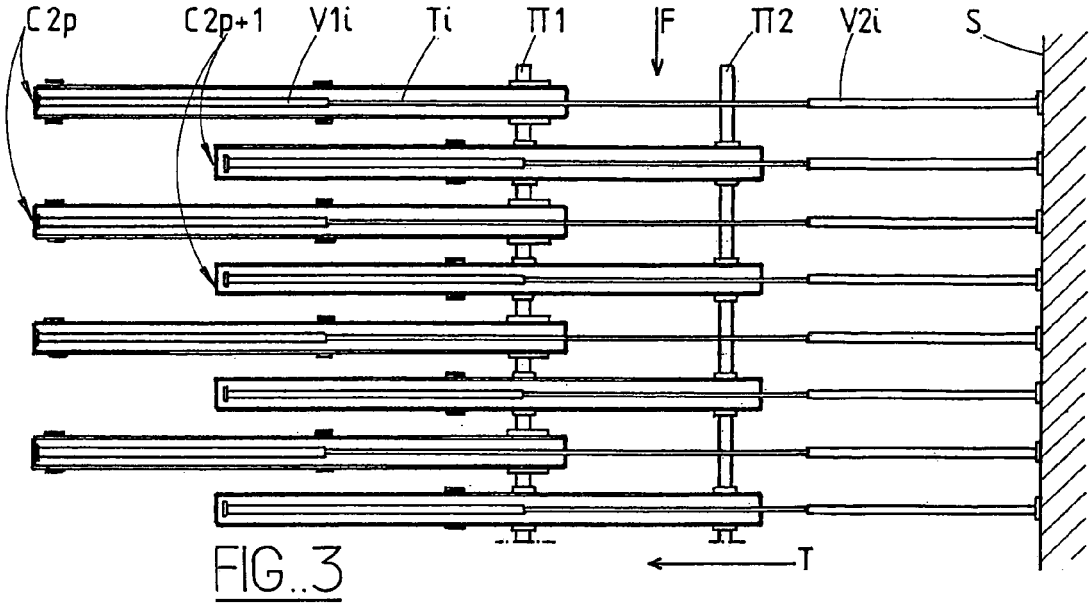
FIG..3
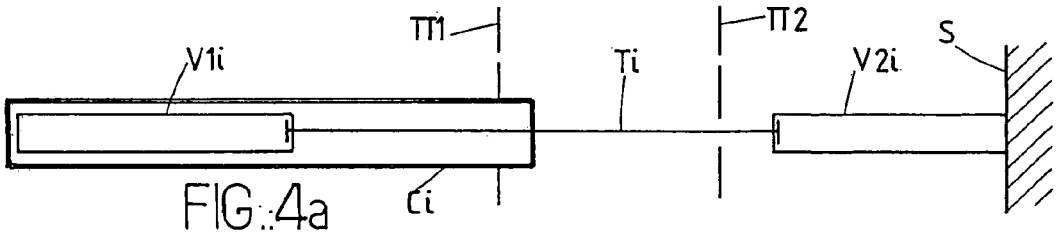
FIG.:4a
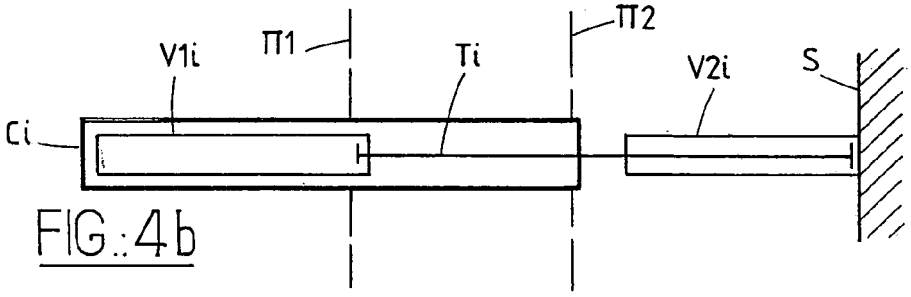
FIG.:4b
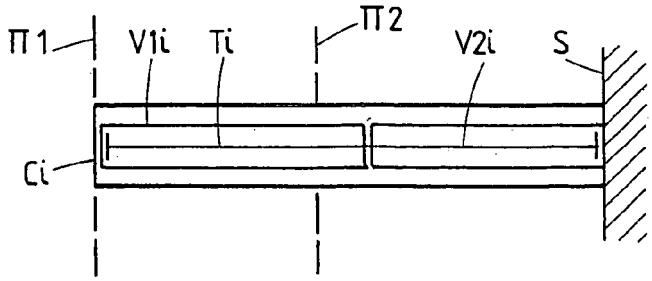
FIG.:4c

CONTOUR ROLL FORMER IN PARTICULAR FOR EXTRUDED METAL PROFILES

This is a nationalization of PCT/FR02/03660 filed Oct. 24, 2002 and published in French.

BACKGROUND OF THE INVENTION

1. Field of the Invention

The present invention relates to roll forming apparatus for fabricating sections, in particular metal sections.

2. Description of the Related Art

There exists prior art roll forming apparatus that can operate with different sets of pairs of profiling heads according to the type of section to be fabricated.

Conventionally, when it is required to change from fabricating one type of section to another, the roll forming apparatus must be stopped and all of the pairs of roll forming heads situated on the roll forming line, i.e. on the path followed by the plate to be roll formed, must be replaced one by one.

This takes a very long time and seriously compromises the productivity of the roll forming apparatus.

Furthermore, this operation necessitates the use of lifting equipment such as a traveling overhead crane, which is hazardous for personnel and can cause serious accidents.

SUMMARY OF THE INVENTION

An object of the present invention is to remedy these drawbacks.

The above object of the invention is achieved with roll forming apparatus of the type able to operate with different sets of pairs of roll forming heads according to the type of section to be fabricated, characterized in that said pairs of heads are mounted on carriages that can slide both ways in a direction transverse to the roll forming line, so that one set can be replaced by another set with minimum handling.

Thanks to these features, it suffices to slide the carriages to install the required set of pairs of roll forming heads, which considerably reduces the down time of the roll forming apparatus and eliminates the risks inherent to the lifting operations used in the prior art.

According to other features of the invention:

said roll forming apparatus includes carriages supporting a plurality of pairs of roll forming heads belonging to separate sets, said roll forming apparatus includes separate groups of carriages supporting pairs of roll forming heads belonging to different sets, said roll forming apparatus includes first and second sets of pairs of roll forming heads mounted side by side on a first group of carriages and third and fourth sets of pairs of roll forming heads mounted side by side on a second group of carriages independent of said first group, said roll forming apparatus includes at least one double-acting ram for moving each of said carriages, said roll forming apparatus includes two double-acting rams mounted in opposition for moving each of said carriages to place selectively carriages of said first group in one of the following three positions: heads inactive, first set of heads active, second set of heads active, and to place selectively the carriages of said second group in one of the following three positions: heads inactive, third set of heads active, fourth set of heads active, one ram is longer than the other ram to allow for the overall size of a motor for driving pairs of roll forming heads supported by the corresponding carriage, said roll forming apparatus includes means for preventing it from starting before said carriages have reached an alignment enabling the use of one of said sets, said means comprise a plurality of holes formed in said carriages and disposed so as to be aligned when said alignment is reached and a laser beam adapted to pass through all of said holes when said alignment is reached, said carriages are mounted on wheels rolling on rails and said rails comprise recesses disposed to index the positions of said carriages corresponding to the use of each of said sets, said roll forming apparatus includes gantries provided with wedges adapted to support said carriages when said wheels are in said recesses.

BRIEF DESCRIPTION OF THE DRAWINGS

Other features and advantages of the roll forming apparatus according to the invention will become apparent on reading the following description and examining the accompanying drawings, in which:

FIG. 3 is a bottom view of a portion of the roll forming apparatus shown in FIG. 1, and FIGS. 4*a*, 4*b*, 4*c* are diagrams showing three positions that each carriage can occupy.

DETAILED DESCRIPTION OF THE PREFERRED EMBODIMENTS

Figures 1, 1A, 1B, 2, 2A:
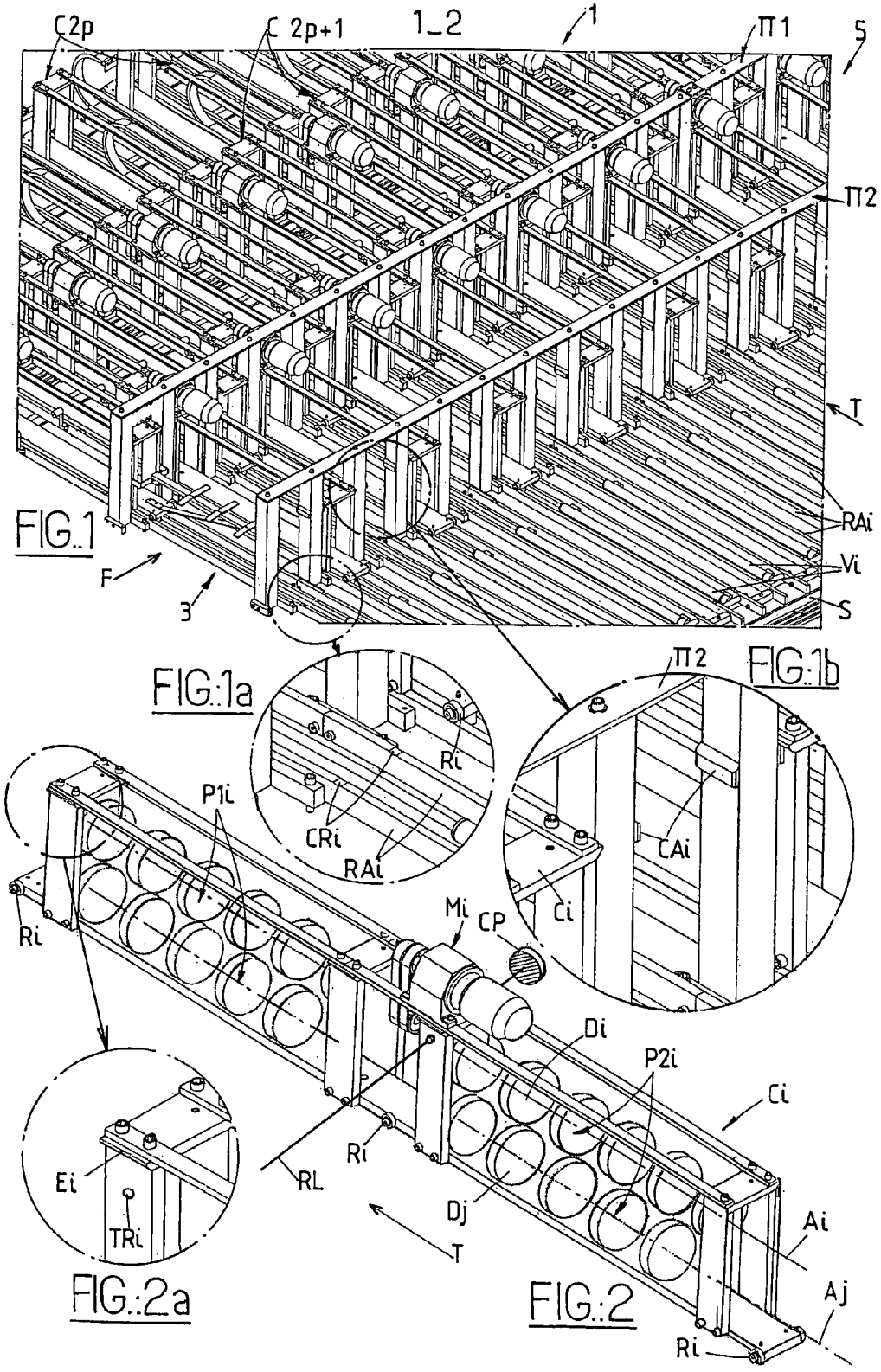
FIG. 1 is a partial perspective view of roll forming apparatus according to the invention.
FIGS. 1*a* and 1*b* show details of FIG. 1 to a larger scale.
FIG. 2 is a perspective view of a carriage of the roll forming apparatus supporting first and second pairs of roll forming heads belonging to respective different sets.
FIG. 2*a* shows a detail of FIG. 2 to a larger scale.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Refer now to FIG. 1, which shows that the roll forming apparatus 1 according to the invention comprises a plurality of carriages Ci disposed transversely to the roll forming line indicated by the arrow F.

The person skilled in the art will understand that the expression "roll forming line" refers here to the path to be taken by each plate to be roll formed inside the roll forming apparatus 1, between its entry 3 and its exit 5.

It will be noted that the carriages Ci for which i is even (i=2p) are offset transversely, i.e. in the direction shown by the arrow T perpendicular to the arrow F, relative to the carriages Ci in which i is odd (i=2p+1) for reasons that are explained later.

These two groups of carriages are respectively referred to hereinafter as the "even carriage group" and the "odd carriage group".

Refer next to FIG. 2, in which it can be seen that each carriage Ci includes first and second pairs P1*i* and P2*i* of roll forming heads disposed side by side, i.e. aligned with each other in the direction T.

It will be noted that in the present context the expression "roll forming head" means a plurality of discs Di, preferably metal discs, supported by a common shaft Ai, each pair of heads P1*i*, P2*i* thus being formed of two such pluralities of discs Di, Dj mounted on two parallel shafts Ai, Aj.

It will be noted that, for reasons of clarity only, these pairs of heads are not shown in FIG. 1.

The combination of pairs P1*i* for which i is even, P1*i* for which i is odd, P2*i* for which i is even, and P2*i* for which i is odd defines four respective sets of pairs of heads, each of which sets produces sections of a particular type.

It is therefore clear that the term "set of pairs of heads" refers to all of the pairs of heads placed one after the other in the direction F (see FIG. 1) for producing a predetermined type of section.

Each carriage Ci further comprises a gear motor Mi for driving the two pairs of heads P1*i* and P2*i* which is supplied with power by appropriate electrical connections, not shown.

The discs Di, Dj of each pair of heads turn in opposite directions to confer the required shape progressively on the plates fed to the roll forming apparatus 1. This is known in the art.

Each carriage Ci has wheels Ri on which the carriage slides on corresponding rails RAi (see FIG. 1).

As can be seen in the FIG. 1*a* detail view, the rails RAi comprise recesses CRi adapted to receive the wheels Ri.

Referring again to FIG. 1, it will also be noted that the roll forming path is delimited by a first gantry Π1 and a second gantry Π2.

As can be seen in the FIG. 1*b* detail view, a plurality of wedges CAi are fixed to the gantries and adapted to cooperate with shoulders Ei formed on each carriage Ci (see the FIG. 2*a* detail view) when the wheels Ri are in the recesses CRi.

It will also be noted (see FIG. 1) that double-acting rams Vi are disposed between each carriage Ci and a fixed support S connected to the floor.

Referring next to FIGS. 3, 4*a*, 4*b* and 4*c*, it is seen that each carriage Ci is in fact connected to the fixed support S by two double-acting rams V1*i* and V2*i* having a common piston Ti.

The ram V1*i* connected to the carriage Ci is preferably longer than the ram V2*i* connected to the fixed support S.

The rams are fed by appropriate hydraulic connections, not shown.

Referring more specifically to FIGS. 4*a*, 4*b* and 4*c*, it can be seen that each carriage Ci can occupy three different positions corresponding to different situations of the rams V1*i* and V2*i*.

The position shown in FIG. 4*a* corresponds to the situation in which the rams V1*i* and V2*i* are both extended.

The even carriage group is in this position in FIGS. 1 and 3.

The carriages are therefore as far as possible from the fixed support S, and neither the pairs of heads P1*i* nor the pairs of heads P2*i* are in the roll forming area between the gantries Π1 and Π2: these heads are therefore inactive.

The position shown in FIG. 4*b* corresponds to the situation in which the ram V1*i* is extended and the ram V2*i* is retracted.

The odd carriage group is in this position in FIGS. 1 and 3.

In this position, the pairs of heads P2*i* are in the roll forming area: these heads are therefore active.

The position shown in FIG. 4*c* corresponds to the situation in which the rams V1*i* and V2*i* are retracted (this position is not shown in FIGS. 1 and 3).

In this position, the pairs of heads P1*i* are in the roll forming area: these heads are therefore active.

The roll forming apparatus 1 preferably includes means for preventing it from starting if the carriages Ci have not reached an alignment enabling use of the required set of pairs of heads.

As can be seen in FIGS. 2 and 2*a*, such means can comprise holes TRi formed in each carriage Ci and a laser beam RL disposed to pass through the holes TRi of all the carriages Ci when said alignment is reached and thus to illuminate a photoelectric cell CP to authorize starting of the roll forming apparatus.

The mode of operation and the advantages of the roll forming apparatus follow directly from the foregoing description.

To fabricate metal sections, metal plates are passed from the entry 3 to the exit 5 in the direction F between the gantries Π1 and Π2 (see FIG. 1).

When the carriages Ci are in the position shown in FIGS. 1 and 3, the plates therefore pass between the roll forming heads of the pairs P2*i* for which i is odd.

Thus sections of a first type are obtained.

To obtain sections of the type corresponding to the sets of heads P1*i* in which i is odd, it suffices to place the odd carriage group in the position shown in FIG. 4*c* and for the even carriage group to remain in the position shown in FIG. 4*a*.

To obtain sections of the type corresponding to the sets of heads P2*i* for which i is even, it suffices to place the odd carriage group in the position shown in FIG. 4*a* and the even carriage group in the position shown in FIG. 4*b*.

To obtain sections of the type corresponding to the sets of heads P1*i* for which i is even, it suffices to place the odd carriage group in the position shown in FIG. 4*a* and the even carriage group in the position shown in FIG. 4*c*.

As is now clear, the roll forming apparatus 1 can fabricate four different types of section simply by sliding the carriages Ci accordingly before commencing fabrication.

It is therefore no longer necessary, as it was in the prior art, to lift each pair of roll forming heads by means of a traveling overhead crane in order to replace it with another pair, which considerably reduces the roll forming apparatus down time and eliminates all risks to personnel associated with lifting operations.

It will be noted that because the rams V1*i* are longer than the rams V2*i* each pair of heads P1*i*, P2*i* can be positioned accurately between the two gantries Π1 and Π2, because the additional length of the rams V1*i* compared to the rams V2*i* substantially corresponds to the axial length of the gear motor Mi.

When it is required to move a carriage Ci from the position shown in FIG. 4*c* (heads P1*i* active) to the position shown in FIG. 4*b* (heads P2*i* active), the relatively long ram V1*i* is operated.

When it is required to move a carriage Ci from the position shown in FIG. 4*b* (heads P2*i* active) to the position shown in FIG. 4*a* (heads inactive), the relatively short ram V2*i* is operated.

When it is required to move a carriage Ci directly from the position shown in FIG. 4*c* (heads P1*i* active) to the position shown in FIG. 4*a* (heads inactive), the rams V1*i* and V2*i* can be operated simultaneously.

Of course, to return the carriage to its starting position, the reverse procedure to that just described is carried out.

The recesses CRi formed in the rails RAi (see FIG. 1*a*) index the positions of the carriages Ci to improve further the accuracy of the transverse positioning of the pairs of heads P1*i*, P2*i*.

By cooperating with the shoulders Ei (see FIGS. 1*b* and 2*a*), the wedges CAi completely immobilize each carriage Ci once the wheels Ri are in line with the recesses CRi corresponding to the required positions.

The holes GRi and the laser beam RL (see FIGS. 2 and 2*a*) prevent the roll forming apparatus from starting before all of the carriages Ci have reached the position corresponding to the type of section to be fabricated.

Of course, the present invention is not limited to the embodiment described and shown, which is provided entirely by way of illustrative example.

For example, the roll forming apparatus according to the invention could comprise only one group of carriages each supporting a plurality of pairs of roll forming heads belonging to separate sets.

Likewise, the roll forming apparatus according to the invention could comprise separate groups of carriages each supporting only one pair of roll forming heads belonging to a given set.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

The invention claimed is:

1. A roll forming apparatus able to operate with different sets of pairs of roll forming heads according to the type of section to be fabricated along a roll forming line, comprising sets of pairs of roll forming heads mounted on carriages that are configured to only slide, independently from each other, horizontally back and forth in a direction transverse to the roll forming line, so that one set of roll forming heads can be replaced by another set solely by horizontal translation of said carriages.

2. The roll forming apparatus according to claim 1, wherein each of said carriages supports a plurality of pairs of roll forming heads belonging to separate sets.

3. The roll forming apparatus according to claim 1, wherein said carriages are divided into separate groups of carriages supporting pairs of roll forming heads belonging to different sets.

4. The roll forming apparatus according to claim 2, wherein first and second sets of pairs of roll forming heads are mounted side by side on a first group of carriages and third and fourth sets of pairs of roll forming heads are mounted side by side on a second group of carriages independent of said first group.

5. The roll forming apparatus according to claim 1, further comprising at least one double-acting ram for moving each of said carriages.

6. The roll forming apparatus according to claim 4, further comprising two double-acting rams mounted in opposition for moving each of said carriages to place selectively carriages of said first group in one of three positions: all first group heads inactive, first set of heads active, second set of heads active, and to place selectively the carriages of said second group in one of three positions: all second group heads inactive, third set of heads active, fourth set of heads active.

7. The roll forming apparatus according to claim 6, wherein each carriage includes a motor for driving pairs of roll forming heads supported by said carriage, one ram being longer than the other ram to allow for an overall size of said motor.

8. The roll forming apparatus according to claim 1, further comprising a detecting element for preventing said apparatus from starting before said carriages have reached an alignment enabling the use of one of said sets.

9. The roll forming apparatus according to claim 8, wherein said detecting element includes a plurality of holes formed in said carriages and disposed so as to be aligned when said alignment is reached and a laser beam adapted to pass through all of said holes when said alignment is reached.

10. The roll forming apparatus according to claim 1, wherein said carriages are mounted on wheels rolling on rails and said rails include recesses disposed to index the positions of said carriages corresponding to the use of each of said sets.

11. The roll forming apparatus according to claim 10, further comprising gantries provided with wedges adapted to support said carriages when said wheels are in said recesses.

12. A roll forming apparatus able to operate with different sets of pairs of roll forming heads according to the type of section to be fabricated along a roll forming line, comprising:

a plurality of carriages, each carriage being configured to slide horizontally back and forth in a direction transverse to the roll forming line, said carriages moving independently from and generally parallel with one another;

a plurality of pairs of roll forming heads mounted on each of said carriages and horizontally movable therewith, each of said roll forming heads including a plurality of discs rotationally supported on a shaft that extends in said transverse direction; and one set of roll forming heads being replaced by another set through horizontal translation of said carriages which brings different sets of roll forming heads into alignment with the roll forming line, the roll forming heads remaining in a fixed relationship with respect to the carriages throughout said roll set replacement.

13. The roll forming apparatus according to claim 12, wherein each carriage supports a plurality of pairs of roll forming heads belonging to separate sets, a single horizontal translation of said carriage able to move one set out of alignment and one set into alignment with said roll forming line, or to bring both sets out of alignment with said roll forming line.

14. The roll forming apparatus according to claim 12, wherein said carriages are divided into two groups and are alternatingly arranged relative to one another, each group supporting pairs of roll forming heads belonging to different sets.

15. The roll forming apparatus according to claim 14, wherein a first group of said carriages carries first and second sets of pairs of roll forming heads mounted side by side, and a second group of carriages carries third and fourth sets of pairs of roll forming heads mounted side by side, said first group and said second group of carriages being independent of one another.

16. The roll forming apparatus according to claim 12, wherein each carriage is connected to a fixed support by two double-acting rams having a common piston, said double-acting rams being mounted in opposition.

17. The roll forming apparatus according to claim 15, further comprising two double-acting rams mounted in opposition for moving each of said carriages to place selectively carriages of said first group in one of three positions: all first group heads inactive, first set of heads active, second set of heads active, and to place selectively the carriages of said second group in one of three positions: all second group heads inactive, third set of heads active, fourth set of heads active.

18. The roll forming apparatus according to claim 17, wherein each carriage includes a motor for driving the pairs of roll forming heads supported by said carriage, one ram being longer than the other ram to accommodate said motor.

19. The roll forming apparatus according to claim 12, wherein each carriage carries two sets of roll forming heads arranged side by side in said transverse direction, a range of said horizontal translation motion enabling said carriage to align either set of roll forming heads with said roll forming line, or to move both sets out of alignment with said roll forming line.

20. A roll forming apparatus able to operate with different sets of pairs of roll forming heads according to the type of section to be fabricated along a roll forming line, comprising sets of pairs of roll forming heads mounted on carriages that are configured to slide horizontally back and forth in a direction transverse to the roll forming line, so that one set of roll forming heads can be replaced by another set through horizontal translation of said carriages, and a pair of gantries, one on either side of said roll forming line, being configured to support said carriage when positioned for use of each of said sets.

* * * * *